US006156963A

United States Patent [19]

Masubuchi et al.

[11] Patent Number: 6,156,963

[45] Date of Patent: Dec. 5, 2000

[54] KEYBOARD ASSEMBLY

[75] Inventors: Takamichi Masubuchi; Kenichi Nishida, both of Hamamatsu, Japan

[73] Assignee: Yamaha Corporation, Hamamatsu, Japan

[21] Appl. No.: 09/027,424

[22] Filed: Feb. 20, 1998

[30] Foreign Application Priority Data

| | | | |
|---|---|---|---|
| Feb. 24, 1997 | [JP] | Japan | 9-054264 |
| Feb. 25, 1997 | [JP] | Japan | 9-041060 |
| Feb. 25, 1997 | [JP] | Japan | 9-041066 |

[51] Int. Cl.[7] ..... G10C 3/12

[52] U.S. Cl. ..... 84/423 R

[58] Field of Search ..... 84/423 R, 424, 84/425, 430, 432, 433, 434, 438

[56] References Cited

U.S. PATENT DOCUMENTS

| | | | |
|---|---|---|---|
| 5,070,218 | 12/1991 | Katsuta | 200/5 A |
| 5,459,282 | 10/1995 | Willis | 84/645 |
| 5,616,880 | 4/1997 | Hayashida et al. | 84/719 |
| 5,895,875 | 4/1999 | Osuga et al. | 84/423 R |
| 5,929,357 | 7/1999 | Masubuchi | 84/423 R |

FOREIGN PATENT DOCUMENTS

| | | |
|---|---|---|
| 6-342281 | 12/1994 | Japan . |
| 7-92963 | 4/1995 | Japan . |

*Primary Examiner*—David Martin
*Assistant Examiner*—Kim Lockett
*Attorney, Agent, or Firm*—Morrison & Foerster

[57] ABSTRACT

A keyboard assembly is constructed by assembling keyboard units. Herein, a hook is formed at one end of the keyboard unit, while an engaging portion (e.g., recess) is formed at another end of the keyboard unit. So, the keyboard units are assembled together in such a way that a hook of a keyboard unit engages with a recess of an adjacent keyboard unit. The keyboard unit is constructed by piling up at least a white key unit having white keys and a black key unit having black keys. Each key unit is formed by the resin to integrally contain keys, connections and a key support. The keys are connected to the key support by the connections such that each of the keys is supported to have a capability of swinging up and down in key-depression-release directions. The connection is constructed by a thick-wall portion whose width is greater than a width of a back end of the key and a thin-wall portion which works as a hinge. In addition, a gate-corresponding portion corresponding to a gate of a metal mold for formation of the key unit is formed at an intermediate position, in a width direction of the key, of the thick-wall portion of the connection. So, the resin material is put into the gate-corresponding portion(s) to perform formation of the key unit. Incidentally, the keyboard assembly can be constructed by a key unit having keys and a lower case which is subjected to flattening and downsizing.

19 Claims, 13 Drawing Sheets

KEYBOARD ASSEMBLY

BACKGROUND OF THE INVENTION

1. Field of the Invention

This invention relates to keyboard assemblies which are used for electronic keyboard instruments such as electronic organs, electronic pianos and synthesizers. This application is based on patent application No. Hei 9-41060, patent application No. Hei 9-41066 and patent application No. Hei 9-54264 all filed in Japan, the contents of which are incorporated herein by reference.

2. Prior Art

As the keyboard assemblies used for the electronic keyboard instruments, the paper of Japanese Patent Laid-Open Publication No. 6-342281 discloses an example of the comb-tooth-type keyboard unit.

The typical construction of the comb-tooth-type keyboard unit will be simply described in conjunction with FIG. 14. FIG. 14 is an exploded perspective view for an assembly of three key units, i.e., two white key units 1, 1' and one black key unit 1".

The white key unit 1 contains multiple keys each denoted by a numeral "2", which are supported by a key support (or key common support) 3. The key support 3 extends in a direction of arrangement of keys (hereinafter, simply referred to as key-arrangement direction). A connection (or supporting point) 4, whose width is equivalent to that of a back end 2*a* of the key 2, connects the key 2 to the key support 3 to provide flexibility that the key 2 can be freely swung up and down in key-depression-release directions A. The aforementioned elements 2, 3 and 4 are formed as integral parts using resin to construct the white key unit 1.

The white key unit 1' and the black key unit 1" are constructed as similar to the aforementioned white key unit 1. Herein, a numeral 3' designates a key support of the white key unit 1' while a numeral 3" designates a key support of the black key unit 1". The key support 3 of the white key unit 1 is placed upon the key support 3' of the white key unit 1'. In addition, the key support 3" of the black key unit 1" is further placed upon the key support 1 of the white key unit 1. So, the three key units are assembled together and are securely fixed to a main frame (not shown) by screws.

For convenience' sake, FIG. 14 provides an illustration such that each of the key units has two keys. Actually, however, the white key unit 1' has four keys corresponding to notes C, E, G and B respectively; the white key unit 1 has three keys corresponding to notes D, F and A respectively; and the black key unit 1" has five keys corresponding to notes C#, D#, E#, G# and A# respectively. The above keys are assembled together to form a keyboard unit of one octave.

A number of keyboard units (each of which is not necessarily limited to the keyboard unit of one octave) are arranged in a key-arrangement direction and are securely fixed to a base (not shown) by screws. Thus, it is possible to construct a keyboard unit having a certain number of keys, such as C37 scale and C49 scale.

Suppose that the keyboard unit of FIG. 14 containing the white key unit 1' and the black key unit 1" is arranged adjacent to a keyboard unit (not shown) containing a white key unit 1'-x and a black key unit 1"-x. Herein, the key support 3' of the white key unit 1' is defined by two ends 3*a*' and 3*b*' while a key support 3'-x of the adjacent white key unit 1'-x is defined by two ends 3*a*'-x and 3*b*'-x; and the key support 3" of the black key unit 1" is defined by two ends 3*a*" and 3*b*" while a key support 3"-x of the adjacent black key unit 1"-x is defined by two ends 3*a*"-x and 3*b*"-x. In this case, the white key unit 1' is placed to partially overlap with the adjacent white key unit 1'-x in such a way that the first end 3*a*' of the key support 3' overlaps with the second end 3*b*'-x of the key support 3'-x, while the black key unit 1" is placed to partially overlap with the adjacent black key unit 1"-x in such a way that the first end 3*a*" of the key support 3" overlaps with the second end 3*b*"-x of the key support 3"-x. Screws are inserted into screw holes of the above key supports as shown by dashed lines in FIG. 14, so the key supports are securely fixed to the base of the main frame (not shown) by screws. Thus, it is possible to mutually interconnect the adjacent key units together with certain positioning.

A keyboard circuit board on which key switches are mounted for keys respectively is provided beneath the keyboard unit.

The aforementioned keyboard unit does not require the mechanical process with respect to the supporting points and frame. In addition, multiple keys are formed integrally as a unit. Therefore, the keyboard unit has a small number of parts, so it is possible to perform construction and maintenance of the keyboard unit with ease. Further, the aforementioned construction of the keyboard unit is very effective in reduction of manufacturing cost.

The aforementioned example of the comb-tooth-type keyboard unit is constructed using the foregoing key units such that ends of the key supports of the adjacent key units are placed to overlap with each other and are tightly fixed each other using fasteners such as screws. In the case of the repairs and maintenance of the keyboard circuit board and the like, it is necessary to remove the key unit arbitrarily selected from the base. In such case, it is impossible to remove the key unit by merely loosening the fasteners. In other words, it is necessary to sequentially remove the key units in accordance with an order of the key-arrangement direction which starts from the key unit having the key of the lowest pitch or the key unit having the key of the highest pitch. So, the aforementioned keyboard unit has a problem that a work efficiency for disassembling is not so good.

At positioning of the key units, projections for positioning are provided to engage with holes to make a gap between adjacent keys constant. Or, a gap between adjacent keys is adjusted manually. So, there is another problem that a work efficiency for positioning is not so good, so gaps become irregular with ease.

The paper of Japanese Patent Laid-Open Publication No. 7-92963 discloses another example of the comb-tooth-type keyboard unit, which is characterized by excluding key guides.

FIG. 15 shows a selected part of a key unit of the keyboard unit. Herein, a key unit 1 has two keys each denoted by a same numeral "2". The keys 2 are connected to a key support 3 by connections 4. A through hole 5 is formed to cut an intermediate part of each connection 4, while each connection 4 has a sufficient degree of flexibility in key-depression-release directions. In addition, each connection 4 has a width "W" in a key-width direction, which is broader than a width "a" of a back end of each key 2. Like the aforementioned keyboard unit of FIG. 14, the keyboard unit of FIG. 15 is constructed by assembling white key units and black key units together to partially overlap with each other. Herein, a connection of a key of one key unit partially overlaps with a connection of an adjacent key of another key unit in a plane with a small gap.

By making the width of the connection 4 to be broader than the width "a" of the back end of the key 2, a second moment of area becomes large with respect to the key-width direction of the connection 4. So, it is possible to sufficiently regulate the lateral swing (i.e., yawing) of the key 2 in the key-width direction without using key guides. Thus, it is possible to manufacture the keyboard unit, which does not have difficulty in playing the performance technique of glissando, with low cost.

In the manufacturing of the conventional keyboard units, at formation of the key unit using the resin, the resin material is provided from the gate of the metal mold to a position corresponding to a side portion of the key(s). This causes an unbalance in flow of the resin material in the metal mold. In some case, the resin material solidifies in a distorted manner, which increases the residual stress of the key unit formed by the resin. For this reason, there is a problem the durability of the key unit is deteriorated. Reduction of the durability occurs particularly around the gate of the metal mold and/or the weld line at which flows of the resin material join together.

Due to the existence of the gate-corresponding portion of the key into which the resin material is put, it may be necessary to provide a long distance for the resin material to flow toward the key support 3. So, the weld line is formed along the connection, which causes a possibility that the durability of the key unit is reduced. The connection act as a hinge, by which the key is connected to the key support such that the key is capable of swinging up and down in key-depression-release directions. So, the connection is formed to have a thin wall. In addition, the force of flexure is frequently applied to the connection, so there is a possibility that the connection is destructed with ease. Due to uneven support intensity, performance feeling (or touch feeling) of the key becomes uneven, so performability of the key is deteriorated.

In the case of the keyboard unit of FIG. 15 that the width of the connection is broadened while the through hole is formed at the intermediate part of the connection, an unbalance state occurs in flow of the resin material with respect to the left side and right side of the connection. This makes the durability of the key unit to be further deteriorated.

Another type of the keyboard unit is constructed by assembling an upper case with a lower case where keys are mounted. In this type of the keyboard unit, bosses are formed to project on the lower case, so a key frame attached to the bosses supports each of keys to have a capability of freely swinging up and down. A keyboard circuit board is attached to a surface of the key frame such that it faces with the keys. Key switches are mounted on the keyboard circuit board to detect key-depression operations of the keys.

A main circuit board on which a sound source circuit and other circuit components are mounted is attached to a back portion of the lower case which is provided backwardly from the key frame.

Connectors are provided for the keyboard circuit board and main circuit board respectively. The connectors are electrically connected by a flat cable. So, a key-on signal produced by a key switch is transmitted to the sound source circuit on the main circuit board via the flat cable.

The flat cable is wired using a space between the key frame and lower case or spaces located at left and right ends of the lower case.

When wiring the flat cable, the above space (or spaces) should be secured in proximity to the lower case or inside of the lower case. Provision of the above space (or spaces) interrupts the flattening and downsizing of the lower case.

In some case, the key frame is omitted so that the lower case is re-designed to directly support each of the keys to have a capability of freely swinging up and down. In that case, it is possible to flatten the lower case. However, no space is formed between the key frame and lower case. In addition, at the key depression, key-depression load of the key is directly imparted to the lower case. For this reason, it is necessary to reinforce the lower case.

When wiring the cable(s) using the spaces located at the left and right ends of the lower case, the cable(s) should be elongated. Thus, the engineer should make a consideration on the noise resistance. In addition, it is necessary to draw in the flat cable toward the left and right ends of the lower cable. So, it is necessary to perform troublesome wiring work.

As described above, the keyboard unit is required to have a lower case which is subjected to flattening and downsizing. Herein, it is demanded that the keyboard unit is designed to have a capability of easy wiring of the cable providing connection between the keyboard circuit board and main circuit board.

Further, it is demanded to provide a keyboard unit whose lower case, which is easily deformed by load(s) because of the flattening, can be reinforced.

SUMMARY OF THE INVENTION

It is an object of the invention to provide a keyboard assembly, constructed by arranging key units in a key-arrangement direction, in which each key unit can be easily removed from a base by merely loosening fasteners.

It is another object of the invention to provide a keyboard assembly that it is possible to easily establish positioning of key units with a good precision while providing a constant gap between adjacent keys.

It is a further object of the invention to provide a keyboard assembly which is manufactured in such a way that an unbalance does not occur in flow of the resin material put into the metal mold to form the key unit while improvements are provided with respect to the durability of the key unit as well as the performability of the key.

It is a still further object of the invention to provide a keyboard assembly constructed by an upper case and a lower case which is subjected to flattening and downsizing but is designed in consideration of the wiring of the cable as well as reinforcement.

According to one aspect of the invention, a keyboard assembly is constructed by assembling keyboard units. Herein, a hook is formed at one end of the keyboard unit, while an engaging portion (e.g., recess) is formed at another end of the keyboard unit. So, the keyboard units are assembled together in such a way that a hook of a keyboard unit engages with a recess of an adjacent keyboard unit. The keyboard unit is constructed by piling up at least a white key unit having white keys and a black key unit having black keys. Each key unit is formed by the resin to integrally contain keys, connections and a key support. The keys are connected to the key support by the connections such that each of the keys is supported to have a capability of swinging up and down in key-depression-release directions. The connection is constructed by a thick-wall portion whose width is greater than a width of a back end of the key and a thin-wall portion which works as a hinge. In addition, a gate-corresponding portion corresponding to a gate of a metal mold for formation of the key unit is formed at an intermediate position, in a width direction of the key, of the thick-wall portion of the connection. So, the resin material is put into the gate-corresponding portion(s) to perform formation of the key unit.

According to another aspect of the invention, a keyboard assembly is constructed by a key unit having keys and a lower case which is subjected to flattening and downsizing. Herein, the key unit is fixed to a protruding portion of the lower case by bosses such that each of the keys is supported to have a capability of swinging up and down in key-depression-release directions. A keyboard circuit board on which key switches are mounted to face with the keys respectively is provided in a space of an attaching portion which is formed to follow the protruding portion in a forward direction of the lower case. A main circuit board is provided in a storage portion which is formed to follow the protruding portion in a backward direction of the lower case. A flat cable is provided to electrically connect the keyboard circuit board and main circuit board. The flat cable is wired using a channel formed across the protruding portion of the lower case.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

[A] First example of the preferred embodiment

Now, a description will be given with respect to a keyboard assembly in accordance with a first example of the preferred embodiment of the invention in conjunction with FIG. 1 to FIG. 5.

Figure 1:
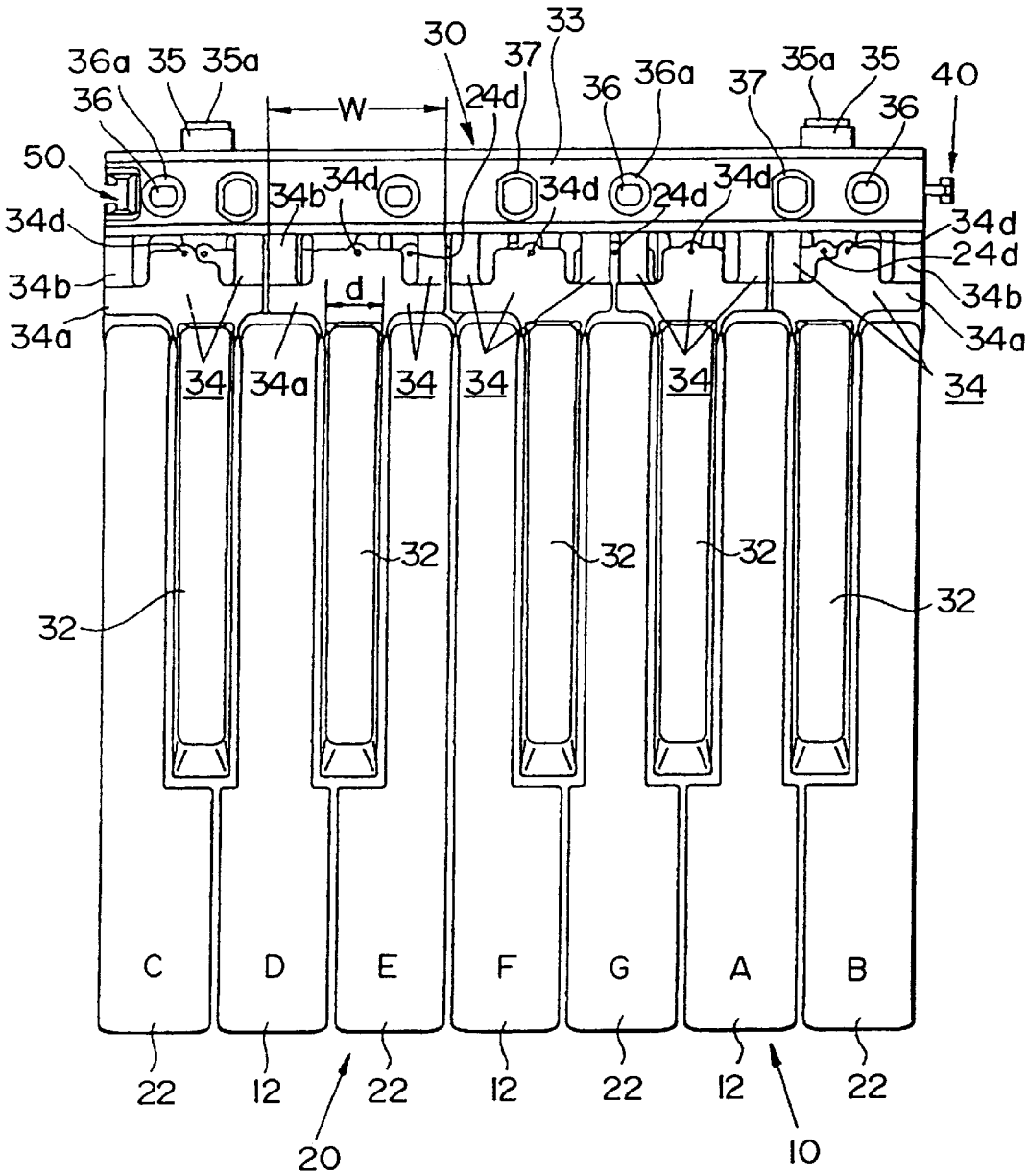
FIG. 1 is a plan view showing a keyboard unit of one octave which is constructed by assembling key units together in accordance with a first example of the embodiment of the invention.
Figure 2:
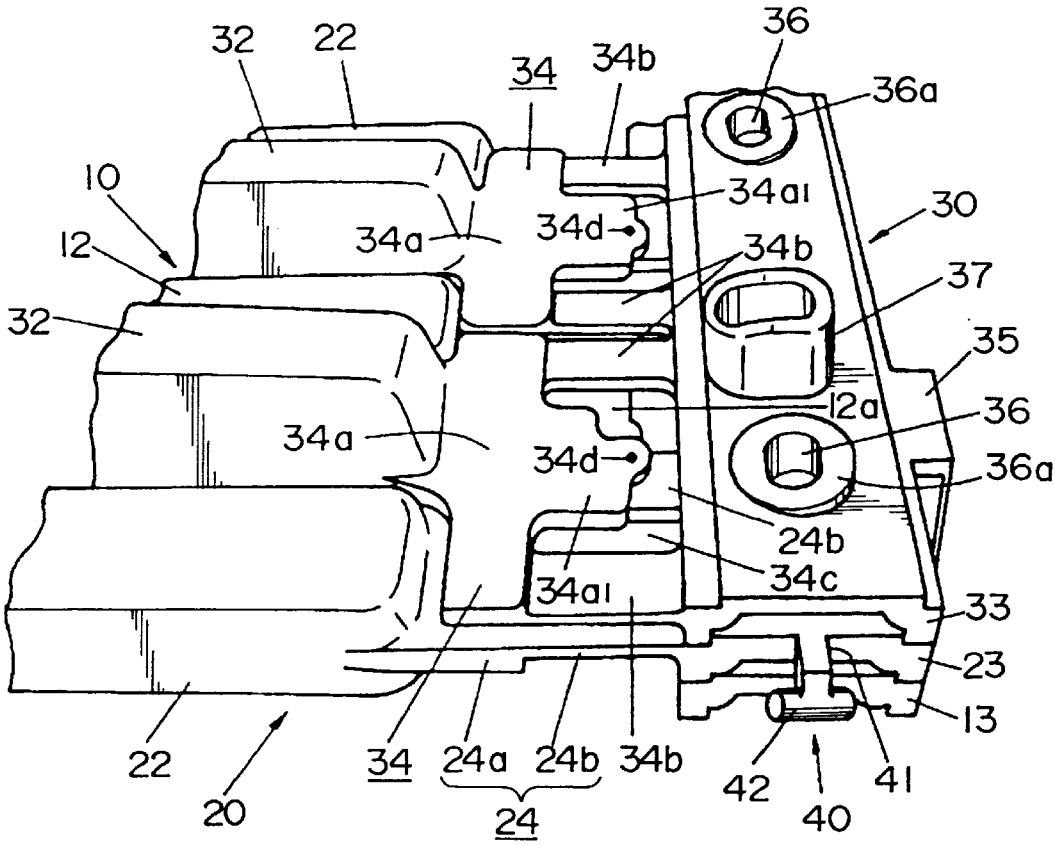
FIG. 2 is a perspective view showing selected parts of the keyboard unit of FIG. 1, equipped with a hook, taken from one end of the keyboard unit.
Figure 3:
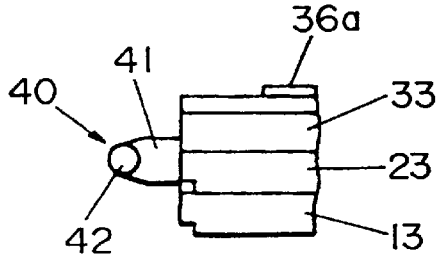
FIG. 3 is a back view showing back faces of key common supports assembled together and equipped with the hook.
Figure 4:
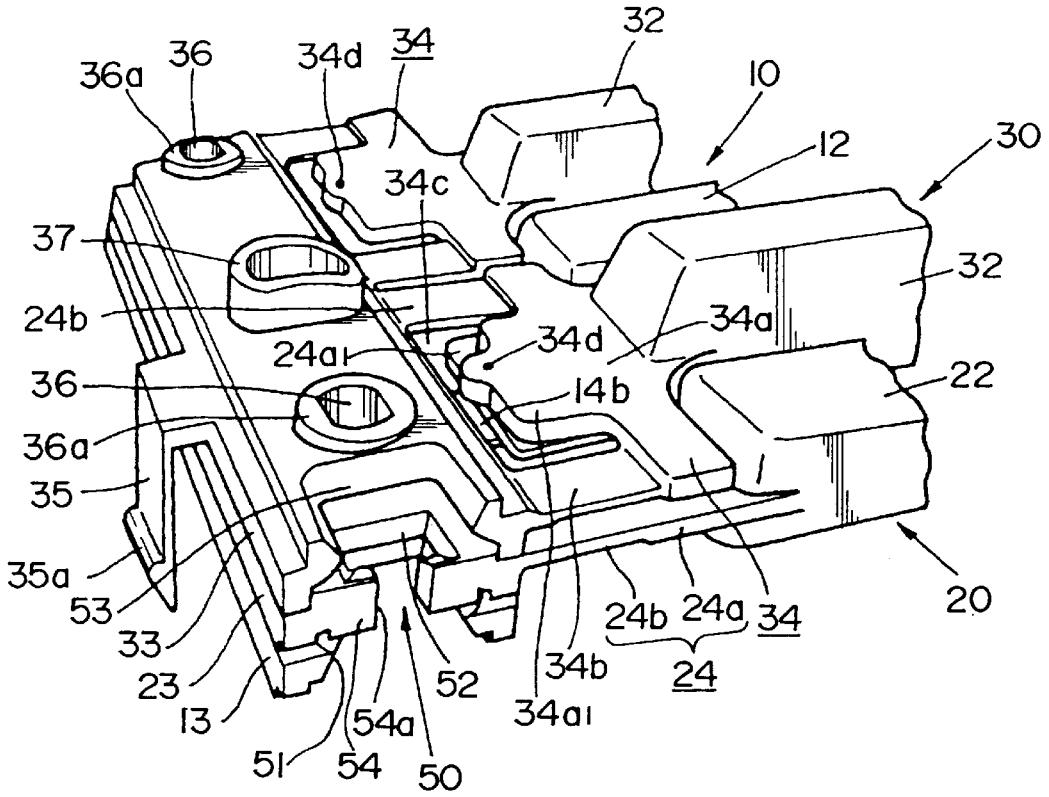
FIG. 4 is a perspective view showing selected parts of the keyboard unit of FIG. 1, equipped with an engaging portion, take from another end of the keyboard unit.
Figure 5:
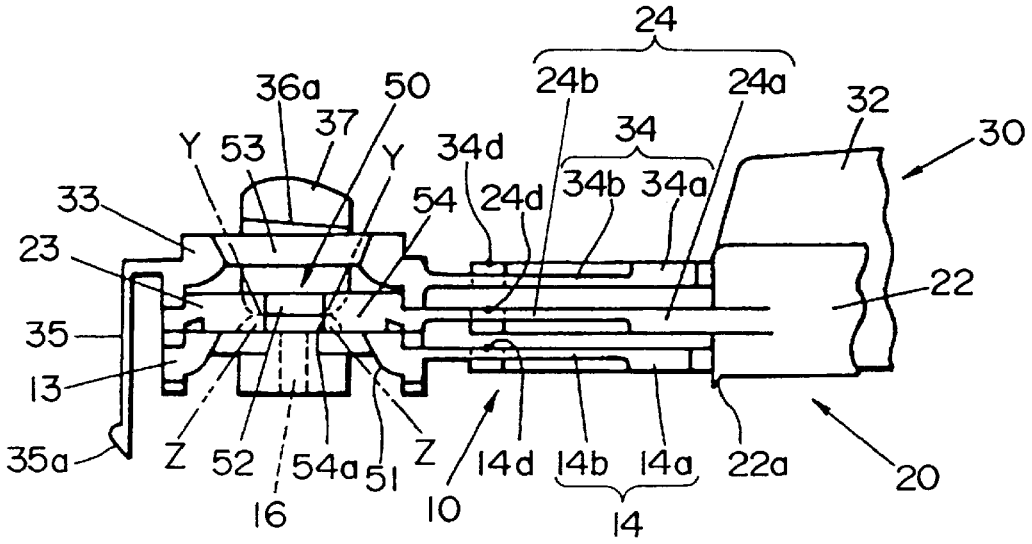
FIG. 5 is a side view, partially in section, showing the keyboard unit of FIG. 1 constructed by assembling the key units.

FIG. 1 is a plan view showing an assembled state of a keyboard unit corresponding to one octave; FIG. 2 is a perspective view showing parts of key units wherein hooks are formed with respect to key supports; FIG. 3 is a back view of the key supports on which a hook is formed; FIG. 4 is a perspective view of the key supports where a stopper is formed; and FIG. 5 is a side view for FIG. 4.

Figure 14:
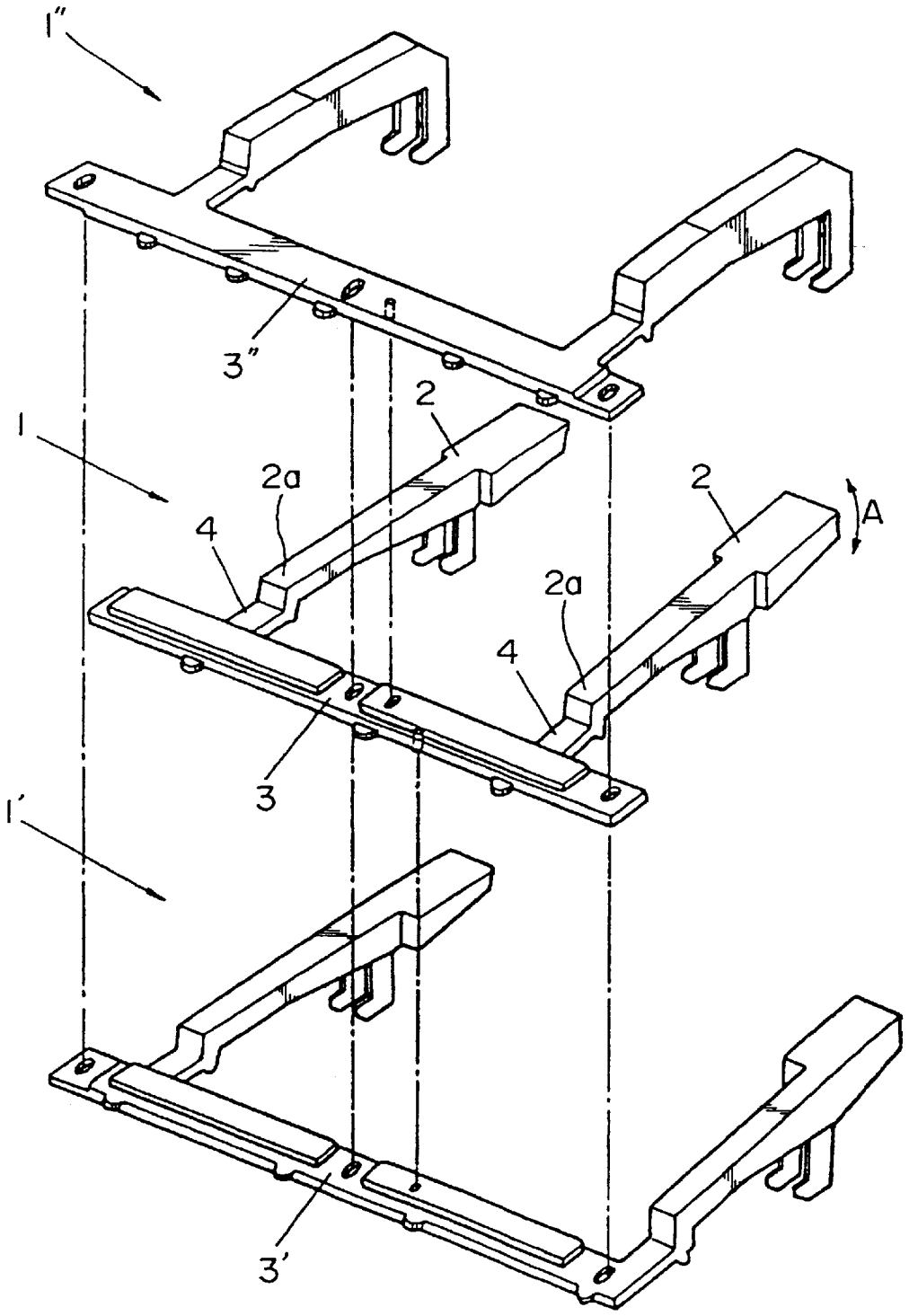
FIG.14 (PRIOR ART)
FIG. 14 is an exploded perspective view of selected parts of the conventional keyboard assembly of the comb-tooth type.
Figure 15:
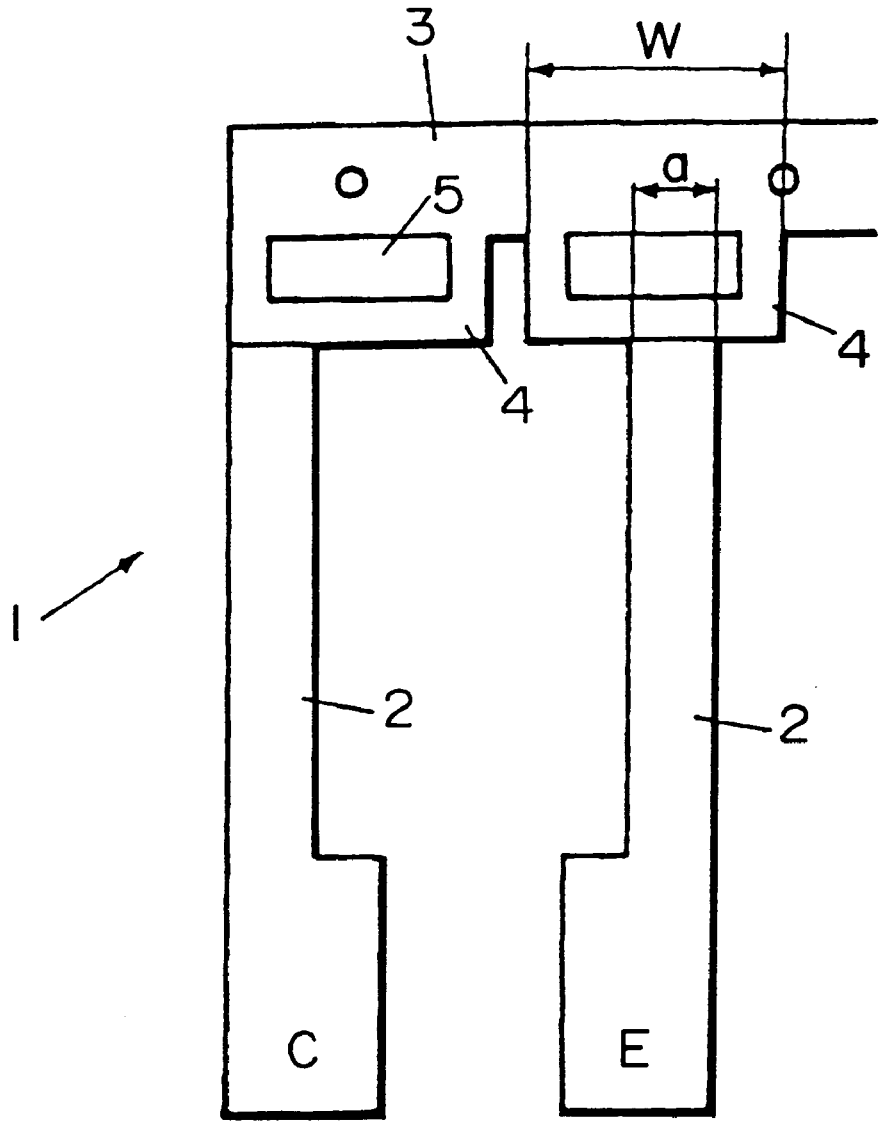
FIG.15 (PRIOR ART)
FIG. 15 is a plan view showing a selected part of a key unit which is used for the conventional keyboard assembly of the comb-tooth type.

Like the conventional keyboard unit of FIG. 14, the keyboard unit of FIG. 1 is constructed by three key units, i.e., a first white key unit 10, a second white key unit 20 and a black key unit 30. It shows a three-layer structure of the keyboard assembly wherein key common supports (or key supports) 13, 23 and 33 are sequentially piled up.

The first white key unit 10 has three white keys corresponding to notes D, F and A, each of which is denoted by a same numeral of "12". Those keys 12 are connected to the key common support 13 by connections 14 (see FIG. 5) in such a way that they are capable of swinging up and down in key-depression-release directions. The second white key unit 20 has four white keys corresponding to notes C, E, G and B, each of which is denoted by a same numeral of "22". Those keys 22 are connected to the key common support 23 by connections 24 in such a way that they are capable of swinging up and down in key-depression-release directions. The black key unit 30 has five black keys corresponding to notes C#, D#, E#, G# and A#, each of which is denoted by a same numeral of "32". Those keys 32 are connected to the key common support 33 by connections 34 in such a way that they are capable of swinging up and down in key-depression-release directions.

Each of the white key units 10, 20 and the black key unit 30 is formed as one integral member by the resin.

In this example, the black key unit 30 is placed at the top of the keyboard unit, which is clearly shown by FIG. 1, FIG. 2 and FIG. 4. So, a description will be given with respect to only the connection 34 of the black key unit 30 while omitting a description with respect to the connections 14 and 24 of the white key units 10 and 20 which are formed similar to the connection 34 of the black key unit 30.

The connection 34 of the black key unit 30 is constructed by a thick-wall portion 34*a* and a pair of thin-wall portions 34*b*. Herein, the thick-wall portion 34*a* is formed by extension of a back end of the key 32. That is, the thick-wall portion 34*a* extends backwardly from the back end of the key 32 and also extends in left-and-right directions of the back end of the key 32. A pair of the thin-wall portions 34*b* work as hinges to connect both sides of the thick-wall portion 34*a* to the key common support 33. A through hole 34*c* is formed between the thin-wall portions 34*b* at an intermediate position of a key-width direction.

An extending portion 34*a*1 extends backwardly from the thick-wall portion 34*a* in such a way that it is put into the through hole 34*c*. A gate-corresponding portion 34*d* is provided in proximity to a tip of the extending portion 34*a*1 at its intermediate position (preferably, center position) of the key-width direction. At formation of the black key unit 30, the resin material is put into the gate-corresponding portion 34*d*.

The key 32 and the key common support 33 are connected together substantially by the aforementioned thick-wall portions 34*b*. By making widths of the thin-wall portions 34*b* to be small, the connection 34 of the black key unit 30 is capable of providing an easy swing motion of the key 32 in key-depression-release directions. As shown in FIG. 1, an overall width W set to the key 32 is made sufficiently broad as compared to a width "d" of the back end of the key 32 in the key-width direction. In addition, the overall width W of the black key 32 partially overlaps with the connection of the adjacent key (i.e., connection 14 or 24 of the white key) on a plane with a small gap.

The thick-wall portion 34*a* is not deformed easily in an overall width thereof. This brings a higher yawing strength for the key 32 in the key-width direction. So, at the (music) performance of the keyboard, the key 32 does not swing practically in the key-width direction. Thus, it is possible to omit provision of key guides.

Like the aforementioned connection 34 of the black key unit 30, the connection 14 of the first white key unit 10 is constructed by a thick-wall portion 14*a* and thin-wall portions 14*b* while the connection 24 of the second white key unit 20 is constructed by a thick-wall portion 24*a* and thin-wall portions 24*b*. A through hole is formed between the above thin-wall portions at an intermediate position of the key-width direction. In addition, an extending portion extends backwardly from a back end of the above thick-wall portion. Further, a gate-corresponding portion (14*d* or 24*d*; see FIG. 1, FIG. 5) is provided in proximity to a tip of the extending portion at its intermediate position (preferably, center position), wherein it is also located at a position such that when the key units are piled up, it does not overlap with the thick-wall portions of other key units. At formation of the white key units 10 and 20, the resin material is put into the gate-corresponding portions 14*d* and 24*d*. Figures of the present example provide merely a part of the above construction.

As described above, the gate-corresponding portions 14*d*, 24*d* and 34*d* are formed at the intermediate positions of the thick-wall portions 14*a*, 24*a* and 34*a* of the connections 14, 24 and 34 respectively. Reasons will be described below.

When the resin material is flown into the gate-corresponding portion from the gate of the metal mold for formation of the key unit, the present example avoids occurrence of an unbalance in flow of the resin material in the key unit, particularly, flow of the resin material across a pair of thin-wall portions of the connection which work as hinges for the key. Thus, the present example brings uniformity of formation and improvement of strength with respect to the key supporting point(s), so that improvements are brought to the performability and uniformity with respect to the key(s).

According to the present example, the gate-corresponding portions 14*d*, 24*d* and 34*d* are provided at the extending portions of the thick-wall portions 14*a*, 24*a* and 34*a* which extend in proximity to the supporting point of the keys respectively. In addition, when the key units 10, 20 and 30 are piled up, the gate-corresponding portions are located at positions to avoid overlapping with the thick-wall portions of the other key units. Reasons will be described below.

The present example avoids an event that when distorted parts of the resin are formed with respect to the gate-corresponding portions 14*d*, 24*d* and 34*d*, they come in contact with the connections of the other key units at depression of the key(s). In addition, the present example constructs the keyboard unit such that the connections of the key units are piled up in proximity to each other in key-depression-release directions.

The key common support 33 of the black key unit 30 is formed to have a capability of supporting the multiple keys 32, so it is formed in a slender shape in the key-arrangement direction and is also formed in a thickness which provides sufficient supporting strength for the keys 32. A pair of fixing elements 35 are provided for temporary fixing. The fixing elements 35 extend backwardly from a back face of the key common support 33 in proximity to its both ends, wherein they are bent to extend downwardly as well. A projecting portion 35*a* is formed at a free end of the fixing element 35, wherein it has a shape to engage with a fixing hole of a frame, which will be described later.

Fixing screw holes 36 are formed sequentially along the key common support 33 in its longitudinal direction at equal intervals of spacing. A holder 36*a* is provided to surround the fixing screw hole 36, wherein an upper surface of the holder 36*a* is formed in a slanted manner. Parts-supports 37 are arranged on the key common support 33 respectively at positions, each of which is set between the fixing screw holes 36. The parts-supports 37 provide arrangements of parts such as the circuit board(s), panel(s), speaker box(es) and floppy-disk box, which are arranged at back positions of the keyboard.

As described above, each keyboard unit is constructed by the white key units 10, 20 and the black key unit 30. Under a state where the key common supports 13, 23 and 33 are piled up, a hook 40 is formed to project from one end of the keyboard unit in the key-arrangement direction. In the present example (see FIG. 1), the hook 40 projects from a high-pitch-side end of the keyboard unit which is close to the key of the high pitch. In addition, an engaging portion 50 is formed to partially cut another end of the keyboard unit in its key-arrangement direction. In the present example (see FIG. 1), the engaging portion 50 is formed at a low-pitch-side end of the keyboard unit which is close to the key of the low pitch. At assembling, the hook of the keyboard unit engages with the engaging portion of the adjacent keyboard unit.

As shown in FIG. 2 and FIG. 3, the hook 40 is constructed by a projection element 41 and a hook element 42. Herein, the projection element 41 projects in the key-arrangement direction from a high-pitch-side end of the key common support 23 of the second white key unit 20. The hook element 42 is formed at a tip of the projection element 41 as its integral part in a cylindrical shape which elongates along a key-longitudinal direction perpendicular to the key-arrangement direction.

The engaging portion 50 is constructed by recesses 51, 52 and 53 which are formed by partially cutting the low-pitch-side ends of the key common supports 13, 23 and 33 of the key units 10, 20 and 30 respectively.

The recess 52 of the key common support 23 of one keyboard unit has a size and a shape, which the hook element 42 of the hook 40 of another keyboard unit is capable of just engaging with. Walls 54 are formed to surround an interior space of the recess 52 of the key common support 23, wherein a slit 54*a* is provided between ends of the walls 54. The slit 54*a* has a width which the projection element 41 of the hook 40 is capable of just passing through.

A taper face is formed at an upper half of an interior wall of the recess 52 of the key common support 23 such that an internal space (or opening) in plan view becomes broad in an upper direction. Herein, the taper face is slightly and concavely curved. In addition, a taper face is formed at an upper half of an interior wall of the recess 53 of the key common support 33 such that an internal space in plan view becomes further broad in an upper direction. So, the recesses 52 and 53 as a whole form a concave defined by imaginary lines Y in FIG. 5 such that a width of the concave becomes narrow in a key-depression direction.

On the other hand, a taper face is formed at a lower half of an interior wall of the recess 52 of the key common support 23 such that an internal space (or opening) in bottom view becomes broader in a lower direction. In addition, a taper face is formed at an interior wall of the recess 51 of the key common support 13 such that an internal space in bottom view becomes further broad in a lower direction. So, the recesses 52 and 51 as a whole form a reversed concave defined by imaginary lines Z such that its width becomes broad in a key-depression direction. Incidentally, a screw hole 16 is formed at a certain position of the key common support 13 which is related to the screw hole 36.

A projection 22*a* is formed to project downwardly from a lower face of a back end of the key 22. When the key 22 is depressed with large intensity of depression, or when a finger of a performer depresses the key 22 at a position in proximity to the connection 24, the projection 22*a* of the key 22 comes in contact with the frame to protect the key 22, which will be described later. Similar projections are formed at lower faces of back ends of the keys 12 as well as lower faces of back ends of the key 32.

Multiple keyboard units, each of which is constructed as described above, are connected with each other in the key-arrangement direction, so that a complete set of the keyboard assembly is constructed. At assembling, adjacent key common units are connected together by engagement of the hook 40 and the engaging portion 50.

Figure 6:
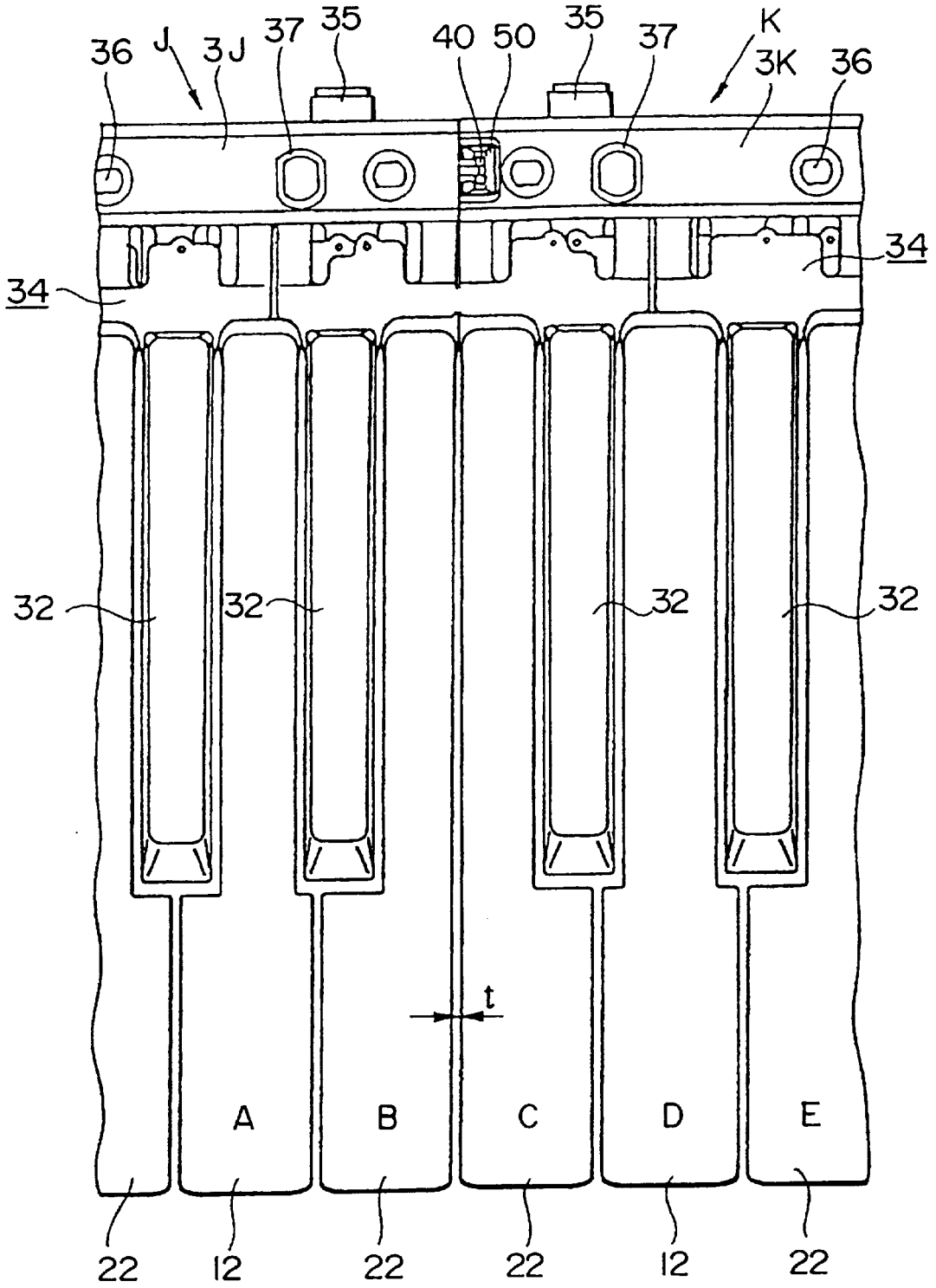
FIG. 6 is a partial plan view showing a connection between keyboard units.

FIG. 6 is a plan view partially showing the keyboard units which are connected together. Specifically, FIG. 6 shows that a first keyboard unit J is connected to a second keyboard unit K. Herein, a hook 40 is formed at a high-pitch-side end of a key common support 3J which corresponds to the key common units (e.g., 13, 23, 33) piled up, while an engaging portion 50 is formed at a low-pitch-side end of a key common support 3K of the second keyboard unit K. So, the hook 40 engages with the engaging portion 50. Due to the engagement of the hook 40 and the engaging portion 50, it is possible to certainly set a relative-positional relationship between the keyboard units J and K. Thus, it is possible to set a constant gap t between keys (e.g., keys of notes B and C in case of FIG. 6) of the adjacent keyboard units. In short, the hook 40 and the engaging portion 50 have functions of connecting and positioning with respect to the adjacent keyboard units J and K.

The engaging portion 50 corresponds to a recess which the hook 40 is capable of engaging with and which the hook 40 is capable of detaching from in a key-depression direction (i.e., vertical direction). So, by merely releasing a fixing state of screws established between the frame and the keyboard unit arbitrarily selected, it is possible to easily remove the keyboard unit while its adjacent keyboard unit is still fixed to the frame. Thus, it is possible to perform the maintenance with ease.

In addition, an upper half of the recess of the engaging portion 50 is formed as a concave whose opening space becomes broad in an upper direction, while a lower half is formed as a reversed concave whose opening space becomes broad in a lower direction. Due to such formation of the engaging portion 50, it is possible to smoothly detach the keyboard assembly from the frame by moving the hook 40 in the vertical direction or by moving the engaging portion 50 in the vertical direction. When the hook 40 engages with the engaging portion 50, the engaging portion 50 has a self-aligning function to automatically guide the hook 40 to a prescribed engaging position (which corresponds to a narrow area of the engaging portion 50) because of formation of the taper face(s) of the engaging portion 50. Thus, it is possible to provide a certain precision of positioning with respect to a gap between keys which are adjacent to each other.

Figure 7:
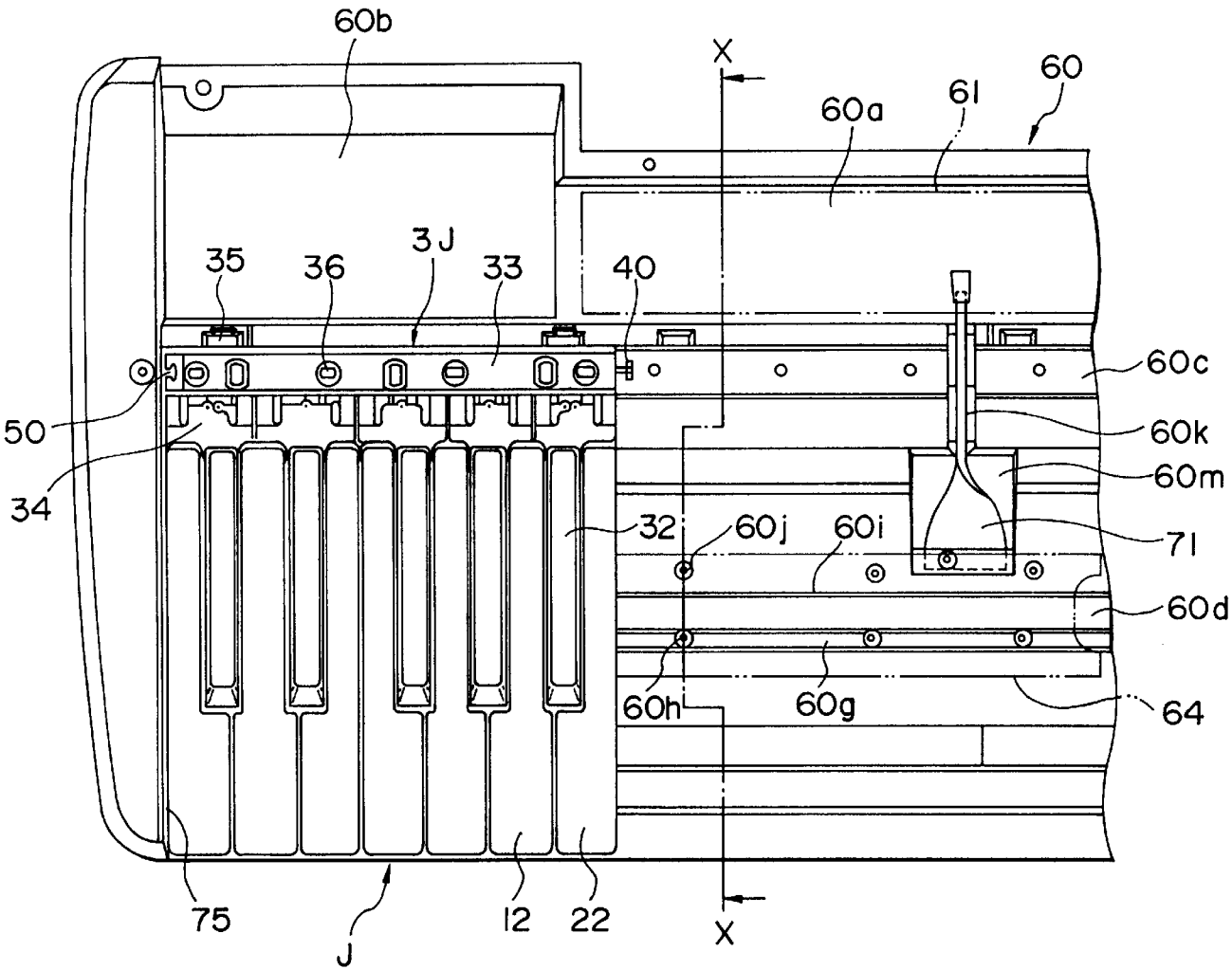
FIG. 7 is a plan view, partially in section, showing the keyboard unit of one octave which is assembled with a frame.
Figure 8:
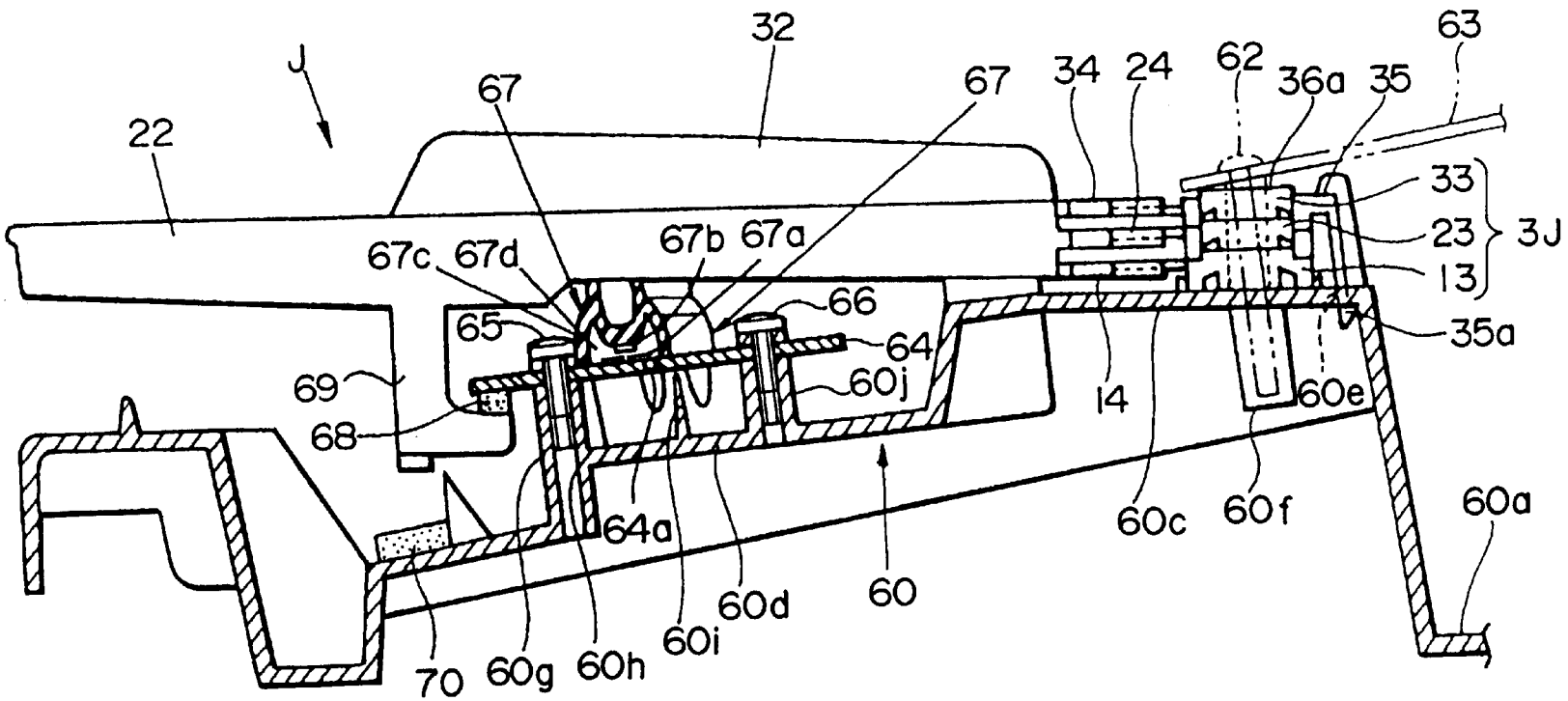
FIG. 8 is a longitudinal sectional view of the keyboard unit of FIG. 7 taken along the line X—X.

FIG. 7 is a plan view showing a low-pitch-register portion of a keyboard unit of one octave (referred to as a keyboard unit J) which is assembled with a frame (i.e., keyboard frame) in accordance with the embodiment of the invention. FIG. 8 is a longitudinal sectional view of the keyboard unit of FIG. 7 taken along the line X—X.

The keyboard unit J is arranged on a frame 60, a back end of which is bent downwardly to provide a recess (or recesses) for a main board storage 60*a* storing a main (circuit) board 61 (shown by an imaginary line in FIG. 7) and a pair of speaker box storage sections 60*b* storing a pair of speaker boxes located at both sides of the keyboard unit. A key unit attaching portion 60*c* is formed to follow the back end of the frame 60 in a forward direction, wherein it is formed as a higher-stage portion of the frame 60. In addition, a key-switch-circuit-board attaching portion 60*d* is formed to follow the key unit attaching portion 60*c* in a forward direction, wherein it is formed as a lower-stage portion of the frame 60 as compared with the key unit attaching portion 60*c*. The frame 60 is formed using a metal plate or resin, wherein it is bent vertically in a complex manner as shown in FIG. 8. By providing reinforcing ribs as integral parts of the frame 60 at essential positions, the frame 60 is capable of having a sufficient strength as a whole.

A key common support portion 3J of the keyboard unit J, which consists of the key common supports 13, 23 and 33 piled up, is mounted on the key unit attaching portion 60*c*. Multiple keyboard units (J) are arranged on the key common support portion 3J in a key-arrangement direction, wherein they are connected each other by engagement of the hook(s) 40 and engaging portion(s) 50. The tips of the fixing elements 35 are placed to engage with fixing holes 60*e*, which are formed along the frame 60 (specifically, key unit attaching portion 60*c*), so as to provide the temporary fixing between the keyboard units and the frame 60.

After the temporary fixing, screws 62 are inserted into the screw holes 36 of the key common support portion 3J, so they are driven in tightly to screw bosses 60*f* which are provided to project downwardly from a lower face of the key unit attaching portion 60*c* of the frame 60. At this time, it is possible to attach a switch panel 63 shown by an imaginary line in FIG. 8 together with the key common support portion 3J by the screws 62 in a slanted manner.

A projecting wall 60*g*, a rib 60*i* and screw bosses 60*j* are sequentially formed on the key-switch-circuit-board attaching portion 60*d* of the frame 60. Herein, the projecting wall 60*g* has an elongated shape which extends in the key-arrangement direction (i.e., left-right direction in FIG. 7). The rib 60*i* is formed to follow the projecting wall 60*g* with a certain spacing in a backward direction of the key, wherein the rib 60*i* has an elongated shape which extends in the key-arrangement direction. As shown in FIG. 7, the rib 60*i* is arranged in parallel with the projecting wall 60*g*. The screw bosses 60*j* are formed to follow the rib 60*i* with a certain spacing in the backward direction of the key. Screw holes 60*h* are formed along the projecting wall 60*g* with certain intervals of spacing in the key-arrangement direction (see FIG. 7).

A key-switch-circuit board 64 is mounted on the projecting wall 60*g* and the screw bosses 60*j*. Screws 65 are driven into the screw holes 60*h* of the projecting wall 60*g*, while screws 66 are driven into the screw bosses 60*j* respectively.

Thus, the key-switch-circuit board 64 is securely fixed to the projecting wall 60*g* and the screw bosses 60*j* formed on the key-switch-circuit-board attaching portion 60*d* of the frame 60 by the screws 65 and 66.

On the key-switch-circuit board 64, key switches 67 are arranged beneath the keys 12, 22 and 32 of the keyboard unit J respectively. The key switch 67 is constructed by a pair of fixed contacts 67*a*, a movable contact 67*b* and a cup-like elastic member 67*c*. Herein, the fixed contacts 67*a* are attached onto the key-switch-circuit board 64, while the cup-like elastic member 67*c* is arranged to provide a closed space 67*d* surrounding the fixed contacts 67*a*, wherein the movable contact 67*b* is attached to an interior wall of the cup-like elastic member 67*c* at a position which is above the fixed contacts 67*a*.

In addition, air holes 64*a* are each formed to penetrate through the key-switch-circuit board 64. The air hole 64*a* is formed at a position which proceeds with the flow-out and flow-in of the air of the closed space 67*d* in response to deformation of the cup-like elastic member 67*c* of the key switch 67 when being depressed and released.

Thus, deformation and restoration of the cut-like elastic member 67*c* can be made smoothly in response to the key depression and key release. So, it is possible to speedily establish an open state and a close state between the fixed contacts 67*a* and the movable contact 67*b*.

The projecting wall 60*g* and the rib 60*i* are formed to surround an area in proximity to outer areas of the air holes 64*a*. So, they act as shield members which avoid intrusion of the dust and the like. Positions of the key switches 67 differ with respect to the white keys and black keys in the longitudinal direction. However, positions of the air holes 64*a* are set to align regularly.

An upper-limit stopper 68 is made by the buffer materials such as the felt and is attached (or adhered) to a lower surface of a front end portion of the key-switch-circuit board 64. The upper-limit stopper 68 is elongated along an overall length of the key-switch-circuit board 64. A L-shaped stopper element 69 projects downwardly from a lower surface of each of the keys 12, 22 and 32. An upper-limit position of the key is defined by the L-shaped stopper element 69 whose tip portion is placed in contact with the upper-limit stopper 68, wherein the key is forced to rotationally move upwardly by the elastic restoration force of the cup-like elastic member 67*c* of the key switch 67. This makes the elevations of the keys even at the non-depression mode.

A lower-limit stopper 70 is made by the buffer materials such as the felt and is adhered to the frame 60 at a position which faces with the stopper elements 69 of the keys. The lower-limit stopper 70 is elongated in the key-arrangement direction on the frame 60. A lower-limit position of the key is defined by the L-shaped stopper element 69 whose lower end portion is placed in contact with the lower-limit stopper 70.

As shown in FIG. 7, a slit 60*k* which elongates in the key-longitudinal direction is formed at a selected position of the key-unit attaching portion 60*c* of the frame 60. In addition, a recess portion 60*m* is formed at a front side of the slit 60*k*. A flat cable 71 is provided to electrically connect the main board 61 and the key-switch-circuit board 64 together. The flat cable 71 passes through the slit 60*k* in such a way that a flat side thereof is placed perpendicular to the bottom of the slit 60*k*. In the recess portion 60*m*, the flat cable 71 is twisted by 90°, so the flat side thereof is placed horizontally on the bottom of the recess portion 60*m*. Then, wires of the flat cable 71 are connected to terminals of the key-switch-circuit board 64.

By loosening fastening of the screws 62 of the keyboard unit J, it is possible to easily release engagement between the hook 40 formed at one end of the keyboard unit J and an engaging portion of an adjacent keyboard unit, and it is also possible to easily release engagement between the engaging portion 50 formed at another end of the keyboard unit J and a hook of another adjacent keyboard unit. Thus, it is possible to remove the keyboard unit J from the adjacent keyboard units.

The present example provides engagement between the hook of the keyboard unit and the engaging portion of the adjacent keyboard unit, wherein the engaging portion is formed by a recess having a self-aligning function. Thus, mutual positioning can be established between the adjacent keyboard units with ease and with a good precision. In addition, it is possible to set a constant gap between the adjacent keyboard units.

According to the present example, the keyboard unit J corresponds to multiple-layer unit consisting of a number of layers (or stages) which is two or more. The hook 40 corresponding to a projection is provided at the second stage or its following stage other than the first stage (i.e., highest stage), while the engaging portion 50 is formed by recesses which are provided for stages of the adjacent keyboard unit which is placed adjacent to the keyboard unit J. Herein, the recesses have different sizes, wherein the recess of the higher stage is made larger than the recess of the lower stage. Thus, it is possible to provide a remarkable effect of the self-aligning function.

According to the present example, the hook 40 is formed at the high-pitch-side end of the key common support 3J of the keyboard unit J in the key-arrangement direction, while the engaging portion 50 is formed at the low-pitch-side end of the key common support 3J of the keyboard unit J. Herein, the engaging portion 50 is formed in an interior area inside of a surface of the low-pitch-side end of the key common support 3J. So, the engaging portion 50 does not project from the surface of the low-pitch-side end of the keyboard unit J. Thus, as shown in FIG. 7, it is possible to facilitate the keyboard unit whose musical interval is the lowest to the frame 60, wherein no special process is required for the keyboard unit. As a result, it is possible to manufacture the keyboard assembly with the low cost.

If the engaging portion (partially) projects from the surface of the low-pitch-side end of the keyboard unit, it is necessary to provide a gap between a key of the lowest pitch and a side board 75; or it is necessary to effect a special process on the frame 60.

The hook may project from a surface of a high-pitch-side end of a keyboard unit whose musical interval is the highest among the keyboard units. A key unit having a highest-pitch key of a note C is assembled in the above keyboard unit of the highest musical interval. So, if the hook is not provided for such a key unit, it is not necessary to effect a special process on the frame 60.

According to the present example, the key support of the key unit is constructed as a key common support supporting multiple keys. This invention is not limited to such an example of the embodiment. So, it is possible to modify the present example such that each key support is constructed to support only one key. Even in such a modified construction, it is possible to demonstrate effects of the present example described before. That is, it is not necessary to provide a supporting portion of a key on the frame; and it is possible to perform assembling and maintenance with ease.

In addition, this invention is not limited to the aforementioned example of the embodiment that multiple keyboard units are assembled together to construct a complete keyboard assembly. So, the property of the invention is applicable to a single keyboard unit.

In the present example, the width of the connection, which connects the key to the key support in such a way that the key is capable of swinging up and down in key-depression-release directions, is made broader than the width of the back end of the key. In addition, the thick-wall portion, which works together with the key, is provided for the connection in its overall width. Thus, it is possible to increase the yawing strength of the key in the key-arrangement direction; and it is possible to omit provision of the key guide(s). The property of this invention is applicable to the aforementioned conventional keyboard unit as well, wherein as shown in FIG. 14, the width of the connection is identical to the width of the back end of the key.

Shapes of the hook and engaging portion which are formed respectively at both ends of the key support (or key common support) of the keyboard unit are not limited to those of the present example. So, they can be changed in a variety of ways.

In the present example, the engaging portion is formed in taper-like construction. However, it is possible to form the hook in taper-like construction.

It is possible to modify the keyboard unit of the present example such that an inserting part, which is inserted into the engaging portion formed at the end of the keyboard unit, is attached to the frame for the temporary fixing, or such that the hook is stopped by a part of the frame. According to such a modification, the positioning can be performed with respect to the key-arrangement direction as well. Thus, it is possible to drive the screws more easily.

The present example indicates an example of the invention which uses the key unit constructed by the keys and key support integrally. However, this invention is applicable to another type of the key unit which is constructed by assembling independent parts corresponding to the keys and key support respectively.

In the present example, the gate-corresponding portion, through which the resin material is put into for formation of the key unit, is formed at the intermediate position of the thick-wall portion of the connection in the key-width direction. This invention is not limited to the present example with respect to the position to form the gate-corresponding portion. For example, the gate-corresponding portion can be formed at an intermediate position of the back end of the key in the key-width direction.

[B] Second example of the preferred embodiment

Figure 9:
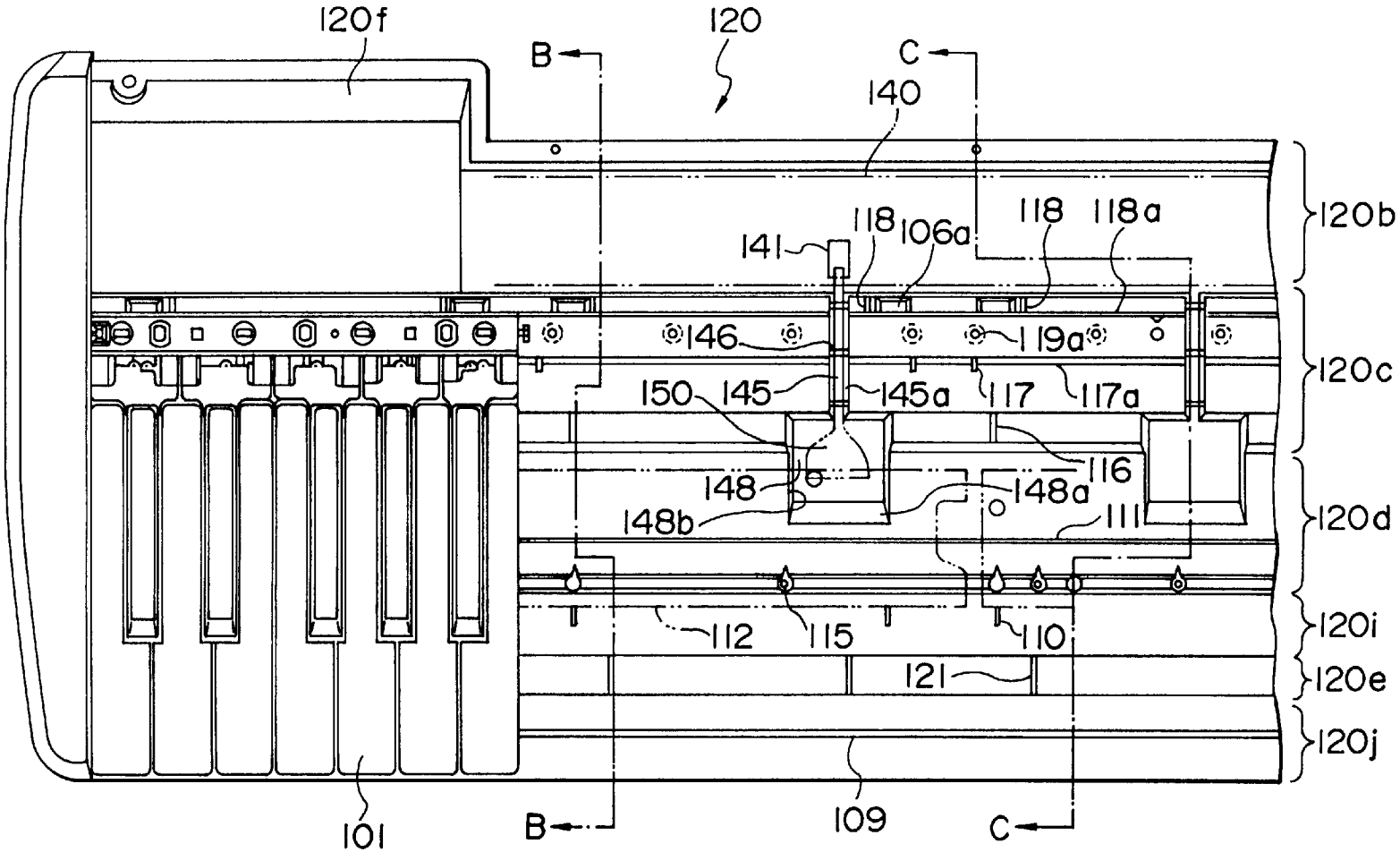
FIG. 9 is a plan view, partially in section, showing a selected part of a keyboard unit constructed by assembling a key unit and a lower case together in accordance with a second example of the embodiment of the invention.
Figure 10:
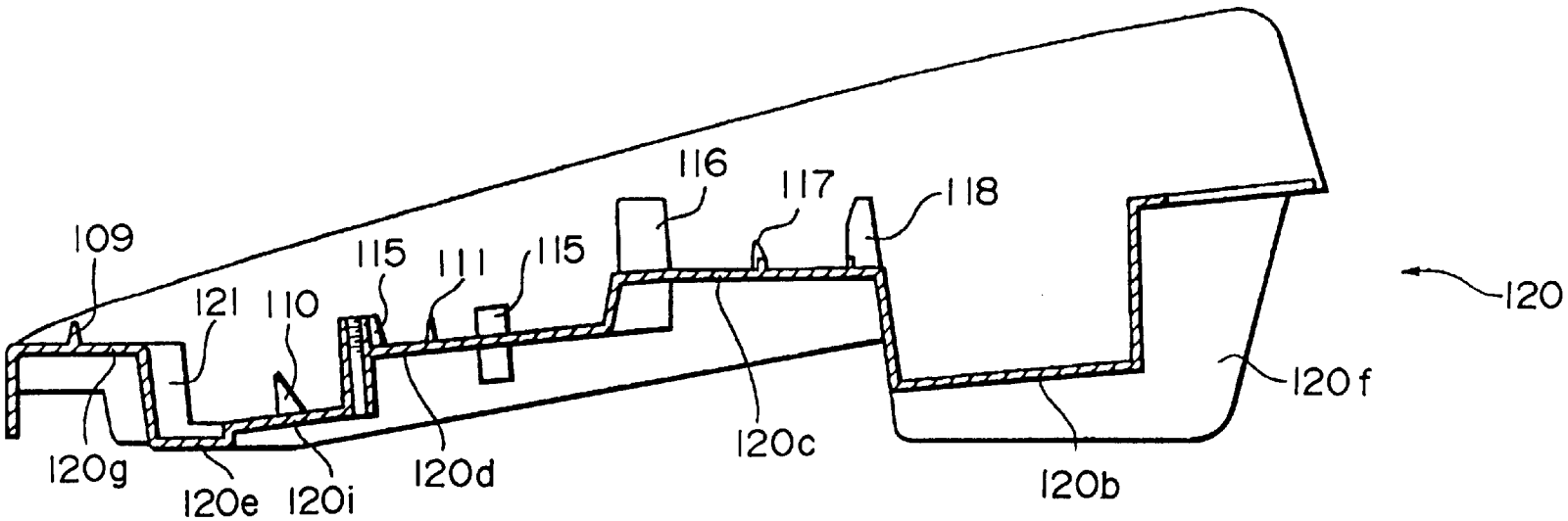
FIG. 10 is a longitudinal sectional view, taken along the line B—B of FIG. 9, which shows a construction of the lower case.

FIG. 9 is a plan view of a keyboard unit, partially in section showing a lower case from its left end to its center portion in accordance with a second example of the embodiment of the invention. FIG. 10 is a longitudinal sectional view of FIG. 9 taken along the line B—B. A lower case 120 is formed as a completely integral part using the resin. A protruding portion 120*c* is formed at a center portion of the lower case and is formed to extend along an overall width of the keyboard unit. A key unit 101 providing keys is attached to the protruding portion 120*c* of the lower case 120. A leg portion 120*f*, containing a broad space therein, is formed at each of the left-back end and right-back end of the lower case 120.

Figure 11:
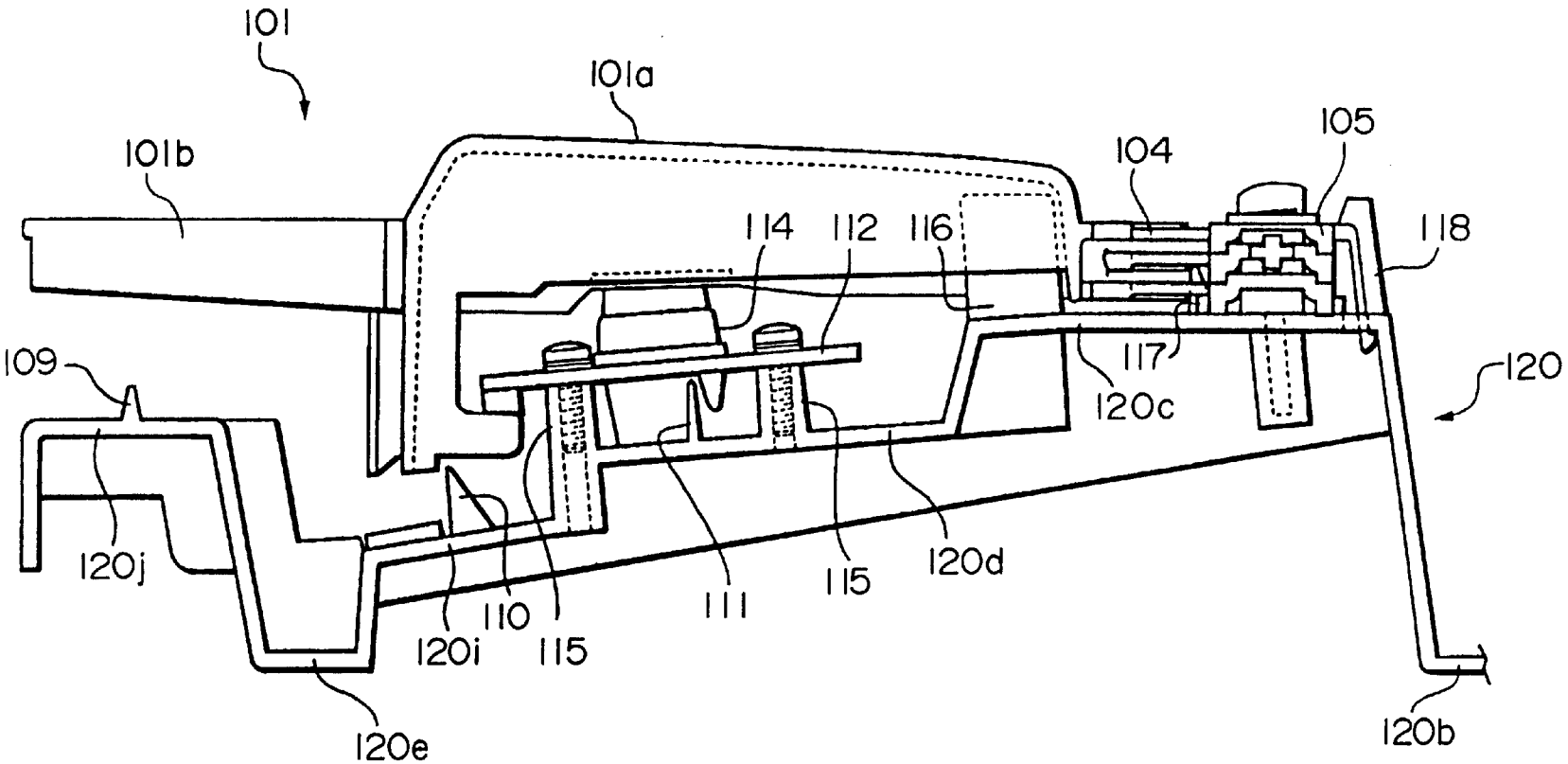
FIG. 11 is a longitudinal sectional view showing a construction of the key unit assembled together with the lower case.

FIG. 11 is a longitudinal sectional view showing an internal construction of the key frame 101 which is attached to the protruding portion 120*c* of the lower case 120. The key unit 101 is constructed by a black key unit 101*a* and a white key unit 101*b*. The black key unit 101*a* has black keys, each of which is supported to have a capability of freely swinging up and down by a hinge 104. Similarly, the white key unit 101*b* has white keys, each of which is supported to have a capability of freely swinging up and down by a hinge 104. Forward-backward guide ribs 116 project from an upper surface of the protruding portion 120*c* to guide the key unit 101 when being assembled with the lower case 120. On a back portion of the protruding portion 120*c* which is located backwardly of the forward-backward guide ribs 116, there are provided forward guide stoppers 117, backward guide stoppers 118, a forward rail 117*a*, a backward rail 118*a* and claw holes 116*a*. Those elements are used for the assembling of the key unit 101. Screw holes 119*a* are formed at equal intervals of spacing on the protruding portion 120*c*. Using the screw holes 119*a*, the key unit 101 is securely fixed to the protruding portion 120*c* of the lower case 120 by screws.

An attaching portion 120*d* is formed to follow the protruding portion 120*c* in a forward direction of the lower case. Herein, the attaching portion 120*d* is lowered in elevation as compared with the protruding portion 120*c*. Bosses 115 are formed on the attaching portion 120*d*. Using the bosses 115, the keyboard circuit board 112 is securely fixed to the attaching portion 20*d* by screws. Key switches 114 are mounted on the keyboard circuit board 112. So, when the black key or white key is depressed, the corresponding key switch 114 produces a key-on signal. A connector (not shown) is attached to a lower surface of the keyboard circuit board 112. A flat cable 150 is connected to the connector, which will be described later. A projecting wall 111 is formed to project from an upper surface of the attaching portion 120*d* in a width direction of the keyboard unit. The projecting wall 111 reinforces the attaching portion 120*d* of the lower case 120.

A lower-limit defining portion 120*i* defining a lower-limit position of the key(s) is formed to follow the attaching portion 120*d* in a forward direction of the lower case 120. Herein, the lower-limit defining portion 120*i* is lowered in elevation as compared with the attaching portion 120*d* in the lower case 120. A leg portion 120*e* is formed to follow the lower-limit defining portion 120*i* in a forward direction of the lower case 120. The leg portion 120*e* cooperates with the aforementioned leg portions 120*f* to support the lower case 120. Lateral guide ribs 110 are provided to project on the lower-limit defining portion 120*i*. The lateral guide ribs 110 regulate a lateral position of the key unit 101 in its width direction. Guide ribs 121 are provided as projections which project on (a bottom of) an interior wall of the leg portion 120*e*. The guide ribs 121 support the key unit 101 when being assembled with the lower case 120.

A front-end portion 120*j* is formed to follow and protrude from the leg portion 120*e* in a forward direction of the lower case 120. A projecting wall 109 is formed to project from an upper surface of the front-end portion 120*j* in a width direction of the keyboard unit. The projecting wall 109 reinforces the front-end portion 120*j* of the lower case 120.

A storage portion 120*b* is formed at a back portion of the lower case 120 which follows the protruding portion 120*c*. The storage portion 120*b* as a whole is lowered in elevation as compared with the protruding portion 120*c*. Screw holes are formed on a bottom surface of the storage portion 120*b* and are arranged at equal intervals of spacing in the width direction of the keyboard unit. Using the screw holes, a main circuit board 140 is attached to the storage portion 120*b* by screws. A sound source circuit and other electronic circuit components are mounted on the main circuit board 140. An end of the flat cable 150 is directly attached to an attaching position 141 of a lower surface of the main circuit board 140.

Figure 12:
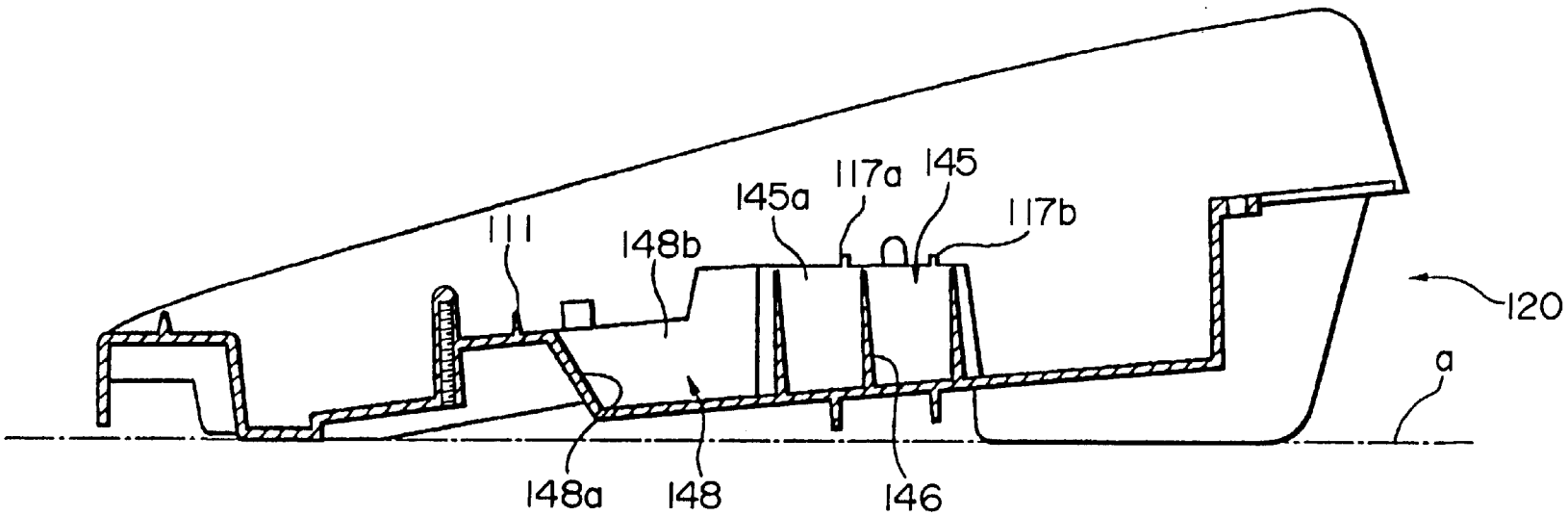
FIG. 12 is a longitudinal sectional view of the lower case taken along the line C—C of FIG. 9.

FIG. 12 is a longitudinal sectional view of the lower case 120 taken along the line C—C of FIG. 9. Channels 145 are formed on the protruding portion 120*c* along several lines which are arranged in the width direction of the keyboard unit. Each channel 45 provides a communication between the space of the storage portion 120*b* and the space of the attaching portion 120*d*. The channel 145 is defined by interior walls 145*a*, which are positioned at both sides of the channel 145. Three projections 146 are formed, with certain intervals of spacing, on each of the interior walls 145*a* of the channel 145. The flat cable 150 is inserted into and drawn through the channel 145. Herein, the flat cable 150 is narrowly sandwiched between the projections 146 of the interior walls 145*a* which face with each other.

A recess portion 148 is formed on the lower case at an area which ranges from a front end of the protruding portion 120*c* to the attaching portion 120*d*. The recess portion 148 communicates with the channel 145 so as to store a part of the flat cable 150 which is drawn through the channel 145. A side wall 148*a*, provided at a front side of the recess portion 148, is formed to have a slanted surface for guiding the flat cable 150.

An end of the flat cable 150 is horizontally inserted into and attached to a connection (not shown) of the keyboard circuit board 112. Then, the flat cable 150 is twisted roughly by 90° in the recess portion 148, so that the horizontally placed flat cable 150 is turned vertically and is inserted into the channel 145 in a vertical manner.

As described above, one end of the flat cable 150 is directly attached to the main circuit board 140, while another end is inserted into the connector mounted on the lower surface of the keyboard circuit board 112. Thus, it is possible to establish an electric connection between the keyboard circuit board 112 and the main circuit board 140. The flat cable 140 contains signal lines for transmitting key-on signals output from the key switches as well as power-source line(s).

As described heretofore, the present example indicates the application of the invention to the case where the flat cable directly attached to the lower surface of the main circuit board is inserted into and attached to the connector mounted on the lower surface of the keyboard circuit board. However, it is possible to modify the present example such that the flat cable directly attached to the lower surface of the keyboard circuit board is inserted into and attached to a connector mounted on the lower surface of the main circuit board. Or, it is possible to modify the present example such that the flat cable is inserted into and attached to both of connectors which are respectively mounted on the main circuit board and keyboard circuit board. Incidentally, the cable applicable to the present example is not limited to the flat cable. So, it is possible to employ the multiconductor cable, earth cable and single cable.

According to the present example described before, the flat cable 150 horizontally extending from the keyboard circuit board 112 is stored in the recess portion 148 in a roughly 90° twisted state. Then, the flat cable 150 is vertically inserted into the channel 145, wherein it is narrowly sandwiched between the projections 146 of the interior walls 145*a* which face with each other.

When the key unit 101 is fixed to the protruding portion 120*c* of the lower case 120, the flat cable 148 is stored in the channel 145 as well as the recess portion 148. So, it is possible to perform fixing work for the key unit 101 without troubles. In addition, the channel 145 and the recess portion 148 form a shortened path connecting between the keyboard circuit board 112 and the main circuit board 140 in a key-longitudinal direction. So, it is possible to shorten the length of the flat cable 150. For this reason, it is possible to perform wiring work for the flat cable while providing a superior noise resistance.

The present example does not provide the spaces for drawing the flat cable at the left and right ends of the lower case as well as the key frame. So, it is possible to realize the flattening and downsizing of the lower case.

The walls 145*a* of the channel 145 and the walls 148*a*, 148*b* of the recess portion 148 function as beams which reinforce the lower case 120 as well. So, it is possible to increase the strength of the lower case 120. If a small flexure occurs at a center portion of the lower case 120 because heavy load is imparted to the lower case 120, the recess portion 148 is lowered to reach a ground level "a" shown by a dashed line in FIG. 12 so that the recess portion 148 works as a leg portion of the lower case as well. Thus, it is possible to avoid further deformation of the lower case 120. Incidentally, it is possible to modify the present example such that the channel and recess portion are formed to have larger depths which align with elevation of bottom levels of the leg portions of the lower case. In that case, the channel and recess portion normally work as leg portions of the lower case.

According to the present example, the flat cable 145 is vertically inserted into the channel 145. So, it is possible to narrow the width of the channel 145. When the forward stopper 117 and the backward stopper 118 used for the assembling of the key unit 101 are arranged with respect to the protruding portion 120*c*, they are somewhat subjected to positional restriction by the channel 145. However, because the present example is capable of narrowing the channel 145, it is possible to reduce such a positional restriction for arrangement of the stoppers.

Figure 13:
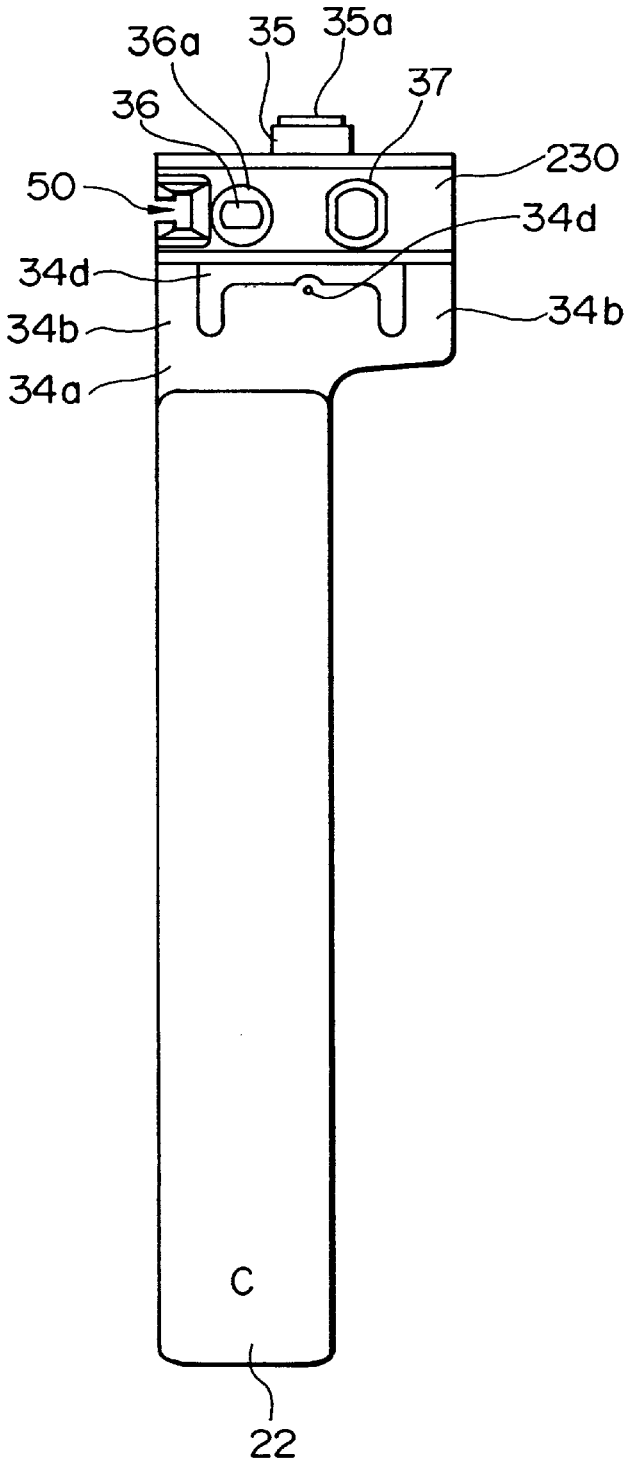
FIG. 13 is a plan view showing a key unit exclusively provided for a key of a highest pitch (or highest note)

FIG. 13 shows a plan view of a key unit exclusively provided for a key of a highest pitch (or highest note) within keys of a keyboard assembly. This key unit does not require other key units to be piled up in key-depression-release directions, so it is provided alone. In the case of the keyboard assembly containing sixty one keys, for example, the above key unit is mounted on the key unit attaching portion 60*c* of the frame 60 in such a way that an engaging portion 50 of the key unit engages with a hook 40 which is provided at a right-side end of a key common support of a keyboard unit corresponding to fifth octave which is counted from a keyboard unit of a lowest octave. Herein, the key unit is subjected to temporary fixing to the frame 60 in such a way that a projecting portion 35*a* of a fixing element 35 of the key unit engages with a fixing hole of the frame. After the temporary fixing, the key unit is securely fixed to the key unit attaching portion 60*c* of the frame 60 by screws (not shown) which are driven in tightly to screw holes 36, 37. Other elements for construction of the keyboard assembly using the key unit of FIG. 13 are similar to those shown in FIG. 1; hence, the detailed description thereof will be omitted.

Incidentally, a key common support 230 of the key unit is constructed by the lightening structure. Herein, width of the key common support 230 measured in the key-depression-release directions is made three times as much as the width of the aforementioned key support (e.g., 3, 23, etc.) which is used for the normal key unit.

As described above, this invention is applicable to the keyboard assembly which uses only one key.

Lastly, all of the examples described heretofore are applicable to the (foot) pedal keyboard.

As this invention may be embodied in several forms without departing from the spirit of essential characteristics thereof, the examples of the present embodiment are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A keyboard assembly comprising:

a plurality of key units which are assembled together in a key-arrangement direction, wherein each key unit integrally contains at least one key, a key support for supporting the key, and at least one connection for connecting the key to the key support such that the key is capable of freely swinging up and down in key-depression-release directions, and wherein a hook is formed to project from one end of the key support of each key unit while an engaging portion, which has a shape engaging with the hook, is formed at another end of the key support of each key unit, so that when assembling the key units, the hook of a key unit is placed to engage with the engaging portion of an adjacent key unit.

2. A keyboard assembly according to claim 1 wherein the engaging portion of the key support of the key unit is formed as a recess which the hook of the key support of the adjacent key unit is capable of engaging with and removing from in the key-depression-release directions.

3. A keyboard assembly according to claim 1 wherein the engaging portion of the key unit is formed as a roughly-V-shaped recess whose opening space becomes narrower in a key-depression direction, so that the hook of the adjacent key unit tightly engages with a narrowed portion of the recess when the key units are assembled together.

4. A keyboard assembly comprising:

a plurality of key units which are assembled together in a key-arrangement direction, wherein each key unit integrally contains at least one key, a key common support for supporting the key, and at least one connection for connecting the key to the key common support such that the key is capable of freely swinging up and down in key-depression-release directions; and positioning means which provides connection between the key common supports of adjacent key units which are assembled together, wherein the positioning means sets a positional relationship between the adjacent key units in a key-longitudinal direction or the key-arrangement direction, or in both of the key-longitudinal direction and the key-arrangement direction, and wherein the positioning means has a self-alignment function.

5. A keyboard assembly comprising:

a plurality of key units which are assembled together in a key-arrangement direction, wherein each key unit integrally contains at least one key, a key common support for supporting the key, and at least one connection for connecting the key to the key common support such that the key is capable of freely swinging up and down in key-depression-release directions, and wherein a hook is formed to project from a high-pitch-side end of the key common support of each key unit while an engaging portion, which has a shape engaging with the hook, is formed inside of a low-pitch-side end of the key common support of each key unit, so that when assembling the key units, the hook of a key unit is placed to engage with the engaging portion of an adjacent key unit.

6. A keyboard assembly constructed by a key unit which integrally contains at least one key, a key support for supporting the key, and at least one connection for connecting the key to the key support such that the key is capable of freely swinging up and down in key-depression-release directions, wherein a gate-corresponding portion is provided at an intermediate position, in a key-width direction, of the connection or a back end portion of the key, so that for formation of the key unit, the resin material is put into the gate-corresponding portion.

7. A keyboard assembly constructed by a key unit which integrally contains at least one key, a key support for supporting the key, and at least one connection for connecting the key to the key support such that the key is capable of freely swinging up and down in key-depression-release directions, wherein the connection having a width, which is identical to or greater than a width of a back end of the key is constructed by a thick-wall portion which works together with the key and a thin-wall portion working as a hinge, and wherein a gate-corresponding portion is provided at an intermediate position, in a key-width direction, of the thick-wall portion of the connection so that for formation of the key unit, the resin material is put into the gate-corresponding portion.

8. A keyboard assembly comprising:

a plurality of key units, each of which integrally contains at least one key, a key support for supporting the key, and at least one connection for connecting the key to the key support such that the key is capable of freely swinging up and down in key-depression-release directions, so that the plurality of key units are piled up such that the key supports thereof overlap with each other, wherein the connection having a width, which is greater than a width of a back end of the key in a key-width direction, is constructed by a thick-wall portion working together with key and a thin-wall portion working as a hinge, while a through hole is formed at an intermediate position, in the key-width direction, of the connection, and wherein a gate-corresponding portion is provided at an intermediate position, in a key-width direction, of the thick-wall portion of the connection which does not overlap with the thick-wall portion of the connection of another key unit when the key units are piled up, so that for formation of the key unit, the resin material is put into the gate-corresponding portion.

9. A keyboard assembly constructed by assembling a lower case and an upper case holding at least one key, said lower case being formed by a protruding portion, which is formed at a back end portion of the lower case to elongate in a key-arrangement direction, at which a back end portion of the upper case is fixed such that the key is supported to have a capability of freely swinging up and down in key-depression-release directions, an attaching portion which is formed to follow the protruding portion in a forward direction of the lower case and which is formed to have an elevation lower than an elevation of the protruding portion, so that a first circuit board facing with the key of the upper case is attached to the attaching portion of the lower case, a storage portion which is formed to follow the protruding portion in a backward direction of the lower case, so that a second circuit board is stored in the storage portion, a channel which is formed through the protruding portion in a key-longitudinal direction, so that a cable connecting the first and second circuit boards is inserted into the channel, and a recess portion for storing a part of the cable, which is formed in proximity to the channel so as to communicate with the channel.

10. A keyboard assembly according to claim 9 wherein the recess portion reinforces the lower case.

11. A keyboard assembly according to claim 9 wherein the cable corresponds to a flat cable, and wherein the flat cable is inserted into and drawn in the channel in a vertical manner, while the part of the flat cable is twisted roughly 90° and is stored in the recess portion.

12. A keyboard assembly comprising:

a plurality of keyboard units assembled together in a key-arrangement direction, wherein each of the keyboard units has at least one key in such a way that the key is capable of swinging up and down in key-depression-release directions, wherein a first engaging portion is provided at a first end of the keyboard unit and a second engaging portion having a shape adapted to engage the first engaging portion is provided at a second end of the keyboard unit, so that when assembling two keyboard units of the plurality of keyboard units, the first engaging portion of the keyboard unit is detachably engaged with the second engaging portion of its adjacent keyboard unit in a vertical direction.

13. A keyboard assembly according to claim 12 wherein each of the keyboard units is constructed by at least a white key unit holding at least one white key and a black key unit holding at least one black key, so that the white key unit and the black key unit are piled up each other to construct the keyboard unit.

14. A keyboard assembly comprising:

a plurality of keyboard units assembled together in a key-arrangement direction, wherein each of the keyboard units has at least one key capable of swinging up and down in key-depression-release directions, and wherein a hook is formed at a first end of the keyboard unit, while a recess which has a shape adapted to engage with the hook, is formed inside of a second end of the keyboard unit, so that when assembling the keyboard units, the hook of the keyboard unit is placed to engage with the recess of its adjacent keyboard unit.

15. A keyboard unit comprising:

at least a white key unit which is integrally constructed using resin material to contain a key support to which at least one white key is connected by means of at least one connection, so that the white key is capable of swinging up and down in key-depression-release directions; and a black key unit which is integrally constructed using resin material to contain a key support to which at least one black key is connected by means of at least one connection, so that the black key is capable of swinging up and down in key-depression-release directions, wherein the connection is constructed by a thick-wall portion whose width is greater than a width of a back end of the key and a thin-wall portion which works as a hinge to provide rotatable motion of the back end of the key.

16. A keyboard unit according to claim 15 wherein a gate-corresponding portion corresponding to a gate of a metal mold for formation of the key unit is formed at an intermediate position, in a width direction of the key, of the thick-wall portion of the connection, so that the resin material is put into the gate-corresponding portion.

17. A keyboard assembly comprising:

a key unit having at least one key; and a lower case which has a protruding portion in a back end thereof, wherein the key unit is fixed to the protruding portion by bosses in such a way that the key is supported to have a capability of swinging up and down in key-depression-release directions;

a keyboard circuit board on which at least one key switch is mounted to face with the key, wherein the keyboard circuit board is provided in a space of an attaching portion which is formed to follow the protruding portion in a forward direction of the lower case; and a main circuit board which is provided in a storage portion which is formed to follow the protruding portion in a backward direction of the lower case; and a flat cable which electrically connects the keyboard circuit board and the main circuit board, wherein the flat cable is wired using a channel formed across the protruding portion.

18. A keyboard assembly according to claim 17 further providing a recess portion which is formed to communicate with the recess and which is formed at a selected area ranging from the protruding portion to the attaching portion, so that a first portion of the flat cable is vertically inserted into and drawn in the channel of the protruding portion, while a second portion of the flat cable is twisted and is horizontally placed in the recess portion.

19. A keyboard assembly according to claim 17 further providing projecting members which are formed at side walls of the channel to narrowly hold the flat cable in a vertical manner.

* * * * *